United States Patent [19]

Browne

[11] Patent Number: 4,821,692

[45] Date of Patent: Apr. 18, 1989

[54] ROTARY VALVE MECHANISM FOR INTERNAL COMBUSTION ENGINE

[76] Inventor: Daniel F. Browne, 1840 Highland Ave., Northbrook, Ill. 60062

[21] Appl. No.: 147,975

[22] Filed: Jan. 25, 1988

[51] Int. Cl.[4] ..... F01L 7/10

[52] U.S. Cl. ..... 123/190 A; 123/190 D

[58] Field of Search ..... 123/190 A, 190 D, 190 BD, 123/190 AA

[56] References Cited

U.S. PATENT DOCUMENTS

| | | | |
|---|---|---|---|
| 2,444,696 | 7/1948 | Riestra et al. | 123/190 D |
| 3,730,161 | 3/1973 | Deane | 123/190 D |
| 3,945,364 | 3/1976 | Cook | 123/190 D |
| 4,116,189 | 9/1978 | Asaga | 123/190 D |
| 4,612,886 | 9/1986 | Hanson et al. | 123/190 D |

*Primary Examiner*—Raymond A. Nelli

*Attorney, Agent, or Firm*—Lee & Smith

[57] ABSTRACT

Disclosed is an improved valve for the fuel intake and exhaust ports of an internal combustion engine. There is formed between each port and its associated cylinder an enlarged chamber within which is rotatably mounted a rotary valve member, preferably spheroidal in shape, which controls the flow of fluid through the chamber and thus thru the port. The valve member is not only rotatable but it is transversely movable relative to its axis of rotation so that it will sweep into sealingly engagement with the portions of the chamber surrounding the juncture with the associated port. The valve members are rotated by means of a segmented shaft and the connection between the shaft and drive members is such that tranverse movement of the valve member relative to the shaft will be permitted only when the rotary valve members in both the intake port and the exhaust port are not aligned to permit fluid movement through either of the ports i.e. during the compression and power strokes.

9 Claims, 4 Drawing Sheets

ROTARY VALVE MECHANISM FOR INTERNAL COMBUSTION ENGINE

BACKGROUND OF THE INVENTION

This invention relates to an improved valving mechanism for an internal combustion engine and more particularly to an improved rotary valve mechanism employed to control the intake of fuel/air mixture into, and/or the exhaust of combusted gasses out of the cylinder of an internal combustion engine.

It has long been known that rotary valves have certain advantages over standard axially moving valves in an internal combustion engine. Rotary valves have fewer moving parts, they are smoother operating, and thus quieter. They also permit a reduction in the height of the head and there is less power consumed by the valve system.

Heretofore rotary valves have been proposed, utilizing a single rotating valve member to handle both the intake of the fuel/air mixture and for exhausting the combusted gasses out of the cylinder. This has resulted in a compromise of the valving which has resulted in an inefficient operation of the engine. Moreover, in a spherical valve system it is difficult to achieve proper sealing of the intake and exhaust ports during the compression and power cycles.

The present invention solves these problems in a unique way providing a pair of rotary valves, one for the intake port and the other for the exhaust port, and permits these valves to move laterally with respect to their axis of rotation to effect sealing of the ports during the compression and power cycles of the cylinder with which they are associated.

SUMMARY OF THE INVENTION

The improved rotary valve system of this invention is used in an internal combustion engine which has a cylinder encasement, such as block and a head, formed with the plurality of cylinders, each cylinder having an intake port and an exhaust port. The rotary valve system comprises an enlarged chamber disposed between and in fluid communication with the associated cylinder and associated port. In the preferred embodiment, the intake port for each cylnder has one enlarged chamber, and the exhaust port for the cylinder has another enlarged chamber.

A rotary valve member, preferably spherical in shape, has a through-channel which is preferably a diametrical bore through the spherical valve member. One such rotary valve member is mounted for rotation within each chamber about a first axis of movement transverse to the valve member through-channel to permit fluid flow through the chamber and between the associated port and cylinder when the through-channel is aligned with the associated port. The valve member is movable within the chamber along a predetermined second axis of movement which is transverse to the first axis of movement and transverse to the valve member through-channel. The movement along this second axis of movement is permitted as the valve member is being rotated about its first axis. A valve member drive means is connected to each valve member for rotating the valve member about the first axis while permitting transverse movement of the valve member along the second axis. Thus the valve member may move transversely outwardly in the chamber to sealingly engage the portions of the chamber surrounding the juncture with the associated port as the valve member is being rotated between the positions of alignment of the valve member through-channel with the associated port. In other words, this outward sweeping movement is permitted primarily during the compression and the power strokes of the cylinder piston when both the intake port and the exhaust ports are closed.

The valve member drive means preferably includes a rotatable shaft and a connector member which operatively connects the rotatable shaft to the valve member for rotational driving of the valve member about its first axis and for permitting transverse movement of the valve member relative to the rotatable shaft and connector member along the predetermined second axis which is substantially normal to the first axis. This connection between the valve member and the connector member is preferably by means of a slide element carried by one of the members, preferably the valve member, and an elongated guideway formed in the other of the members, preferably the connector member. The slide element is fitted within the guideway such as to permit the relative movement of the slide element only along the axial length of the guideway, which constitutes the second axis of movement and is preferably substantially normal to the valve member through-channel. The connector member and the rotatable shaft are preferably connected together by means of external splines on the shaft and internal splines on the connector member, permitting an angular timing adjustment between the two.

DETAILED DESCRIPTION OF THE PREFERRED EMBODIMENT

Figures 1, 7, 8, 9:
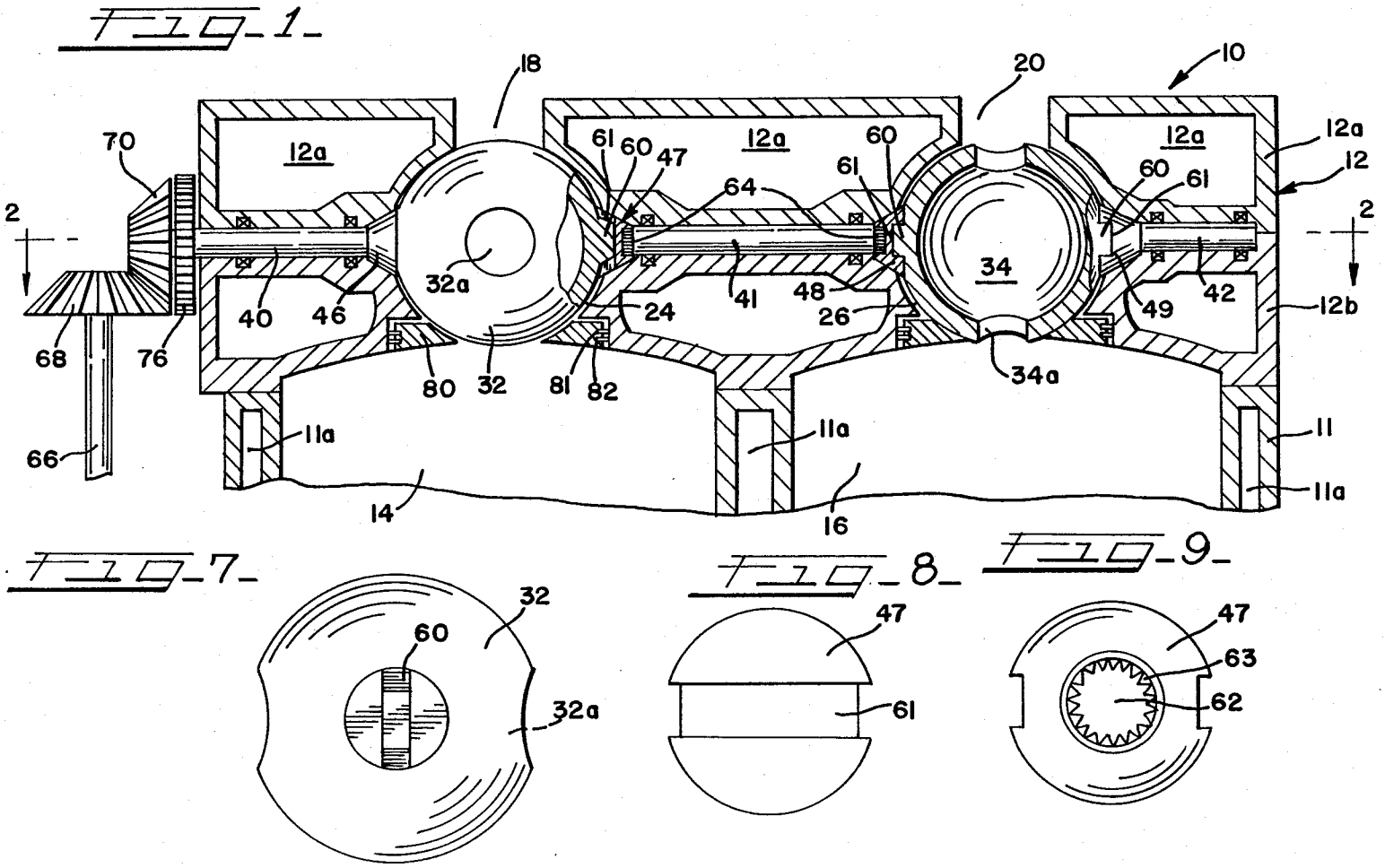
FIG. 1 is a side elevational view in cross section through two cylinders of an internal combustion engine employing rotary valves constructed in accordance with this invention.
FIG. 7 is a further enlarged end view of one of the valve members showing the slide element carried thereby.
FIG. 8 is a still further enlarged end view of one of the drive connectors showing the elongated guideway formed therein.
FIG. 9 is an opposite end view of the drive connector of FIG. 8 showing the internal timing splines for connecting to the externally splined drive shaft.

In FIG. 1 there is illustrated an internal combustion engine 10 having a block 11 and a two piece or split head 12. Within the cylinder block 11 there are formed two cylinders 14 and 16. The block 11 has the usual water jacket 11a and the head 12 has a corresponding water jacket 12*a*. The cylinder block 11 and the head 12 may be considered together as the encasement for cylinders 14 and 16. Each of the cylinders is provided with an intake and an exhaust port. The fuel and air mixture is taken in through the intake port and the exhaust gasses are expelled through the exhaust port. In FIG. 1, only the intake ports are shown; thus there is an intake port 18 for cylinder 14 and an intake port 20 for cylinder 16. As shown in FIGS. 3–6 the cylinder 14 has an exhaust port 22 in addition to the intake port 18, and in the same manner there is an exhaust port (not shown) identical to exhaust port 22 for cylinder 16. The end view of cylinder 16 would be identical to that shown for cylinder 14 in FIGS. 3–6.

Disposed between the cylinder and each of the associated ports is an enlarged chamber which is substantially spherical in shape. Thus between the intake port 18 and its associated cylinder 14, there is an enlarged chamber 24 and between the intake port 20 and its associated cylinder 16 there is a similar enlarged chamber 26. In like manner, between the exhaust port 22 and its associated cylinder 14, there is an enlarged chamber 28 (see FIGS. 2–6). Also between the cylinder 16 and its exhaust port (not shown) there is an enlarged chamber 30 (see FIG. 2). Disposed within each of the enlarged spherical chambers 24–30 there is disposed a substantially spherical, i.e. spheroidal, valve member having a through-channel or a through-bore. Thus in chamber 24, there is spheroidal valve member 32 having a through-channel 32*a*; in chamber 26 there is spheroidal valve member 34 having a through-channel 34*a*; in chamber 28 there is spheroidal valve member 36 having a through-channel 36*a*; and in chamber 30 there is spheroidal valve member 38 having a through-channel 38*a*. In the illustrated embodiment, the spheroidal valve members 32-38 are hollow and their respective through-channels 32*a*–38*a* are cut diametrically through the valve member. It will be appreciated, however, that these through-channels could be formed in the exterior surfaces of the spheroidal valve members rather than through the centers of the valve members, although for efficiency of operation it is preferred that these extend through the center of the valve members. The hollow spinning valve members provide increased full-air mixing as the fuel and air are moved therethrough from the intake port 18 to the associated cylinder. Flow directing impellers (not shown) within the interior of the valve members could provide additional mixing and could also serve to force the mixture into the associated cylinder. The valve members alternatively could be solid, although this would add weight to the internal combustion engine, which is undesirable. The through-channel for each valve permits the passage of gas through the associated port into or out of the associated cylinder when the valve member has been positioned such that the through-channel is aligned with the associated port.

Figure 2:
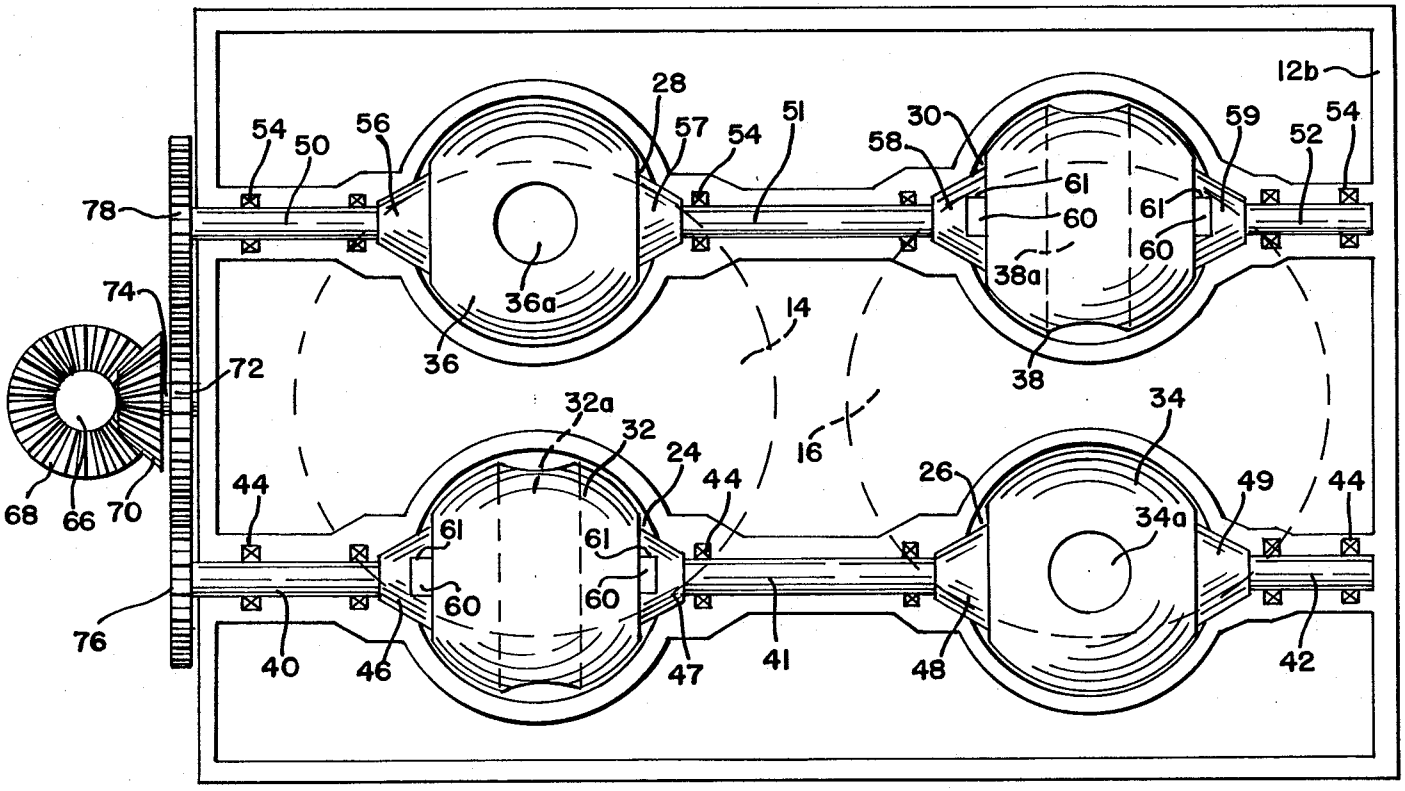
FIG. 2 is a top plan view in cross section through the head of the engine taken substantially along line 2—2 of FIG. 1.

The spherical valve members 32–38 are mounted for rotation within their respective spheroidal chambers 24–30, and the chambers are slightly larger than the valve members for reasons which will be hereinafter explained. The rotational mounting of the valve members within their respective chambers is best illustrated in FIGS. 1 and 2. The valve members 32 and 34 associated with the intake ports 18 and 20 of the illustrated two cylinder internal combustion engine are mounted for rotation on a segmented shaft consisting of shaft segments 40, 41 and 42. These are journalled for rotation in bearings 44. Shaft segment 40 is connected to one side of the spheroidal valve member 32 by means of a connector 46. Shaft segment 41 is connected to the other side of the valve member 32 by means of a similar connector 47 and it is connected to one side of the valve member 34 by means of a similar connector 48. In like manner a connector 49 connects the shaft segment 42 to the other side of the valve member 34. The segments 40–42 of the segmented shaft of course are axially aligned and in the illustrated embodiment extend horizontally the length of the internal combustion engine through the head 12. The valve members 32 and 34 thus rotate on a horixontal axis which is transverse to and preferably perpendicular to the through-channels 32*a* and 34*a* of the valve members 32 and 34 respectively.

In like manner, the segmented shaft for the mounting of the valve members 36 and 38 for the exhaust ports consists of shaft segments 50, 51, and 52 which are journalled in bearings 54 for rotation coaxially about a horizontal axis which is parallel to the horizontal axis of the shaft segments 40–42. Shaft segment 50 is connected to the valve member 36 by means of a connector 56, and shaft segment 51 is connected to the other side of the valve member 36 by a connector 57 and is connected to the valve member 38 by means of a connector 58. Shaft segment 52 is connected to the other side of the valve member 38 by means of the connector 59.

One of the features of the invention is that the valves are not only rotated but they are permitted to move transversely in the chamber within which they are rotating. The chambers are sufficiently large to permit this transverse movement of the valve members. This transverse movement of each valve member in the illustrated embodiment is a sliding movement which is along a second axis of valve member movement transverse to the first axis of valve member movement i.e. the rotational axis of the shaft segments.

The connectors 46–49 and 56–59 are identically constructed, as are the valve members 32-38. In FIG. 7, the end view of the valve member 32 is shown with the opposite side being a mirror image. Thus on each side of the valve member 32, there is formed an enlongated slide element 60 which in end cross section illustrated in FIG. 7 is substantially rectangular and in side cross section illustrated in FIG. 1 is substantially trapezoidal. These slide elements 60 on each valve member are precisely aligned since they operate together to guide the transverse movement of the valve member. One end of the connector 47 has formed therein an elongated channel-shaped guideway 61 which is a close sliding fit with the slide element 60 of the valve member, so that when the slide element 60 is disposed within the guideway 61 with its longitudinal axis aligned with the longitudinal axis of the guideway, it will be permitted to slide longitudinally along the axis of the guideway, but it will be prevented from any movement transverse to the axis of the guideway. The connector guideways 61 on either side of each valve member must also be precisely aligned since they cooperate with the precisely aligned slide elements 60 on the valve member in guiding the transverse movement of the valve member. As may be seen in FIG. 7, the longitudinal axis of the elongated slide element 60 is transverse to and preferably perpendicular to the valve member through-channel 32*a*. Thus the transverse movement of the valve member slide element 60 relative to the guideway 61 is perpendicular to the valve member through-channel 32a. As the valve members are rotated from a position wherein the through-channel is aligned with the corresponding port, the valve member will be permitted to move outwardly in a direction which is not only transverse (preferably perpendicular) to the rotational axis of the valve member, but also transverse (preferably perpendicular) to the through-channel in the valve member.

On the other end of the connector 47 opposite the guideway 61 the connector has a socket 62, the internal peripheral surface of which has a plurality of timing splines 63. The segmented shafts 40–42 and 50–51 each have an externally splined end 64 which mates with the internal timing splines 63 of the socket 62, as best illustrated in FIG. 1. The spline connection between the connector 47 and the associated shaft segment permits an angular adjustment to be made at the connector between the connected valve member and the shaft segment for purposes of adjusting the timing of the position of rotation of the individual valve members. This permits the valve members for adjcent cylinders to be adjusted relative to one another.

The segmented shafts are driven by means of a shaft 66, preferably powered in a four-to-one ratio, from the crank shaft (not shown). That is to say, the crankshaft rotates four times for every complete revolution of the shaft 66, the segmented shafts 40–42 and 50–51, and the valve members 32–38. At the top of the shaft 66 is a horizontal bevel gear 68 which is in driving relationship with a vertical bevel gear 70. The vertical bevel gear 70 is connected to a first spur 72 by means of a horizontal shaft 74. In mesh with the first spur gear 72 is a second spur gear 76 affixed to the end of the shaft segment 40. The first spur gear 72 is also in mesh with a third spur gear 78 is attached to the end of the shaft segment 50. Thus from the vertical shaft 66 through the spur gears 76 and 78 which drive the segmented shafts operating the intake and exhaust valve members respectively, there is a positive gearing connection. This gearing connection could be accomplished by means of a timing belt as well, if desired.

At the juncture of each of the valve chambers 24–30, there is a chamber seal 80 which is held in place by means of rings 81 and 82. The chamber seal 80 is in a close fitting relationship with its associated valve member and prevents the escape of gas into the associated chamber between the chamber wall and the valve member.

Figure 3:
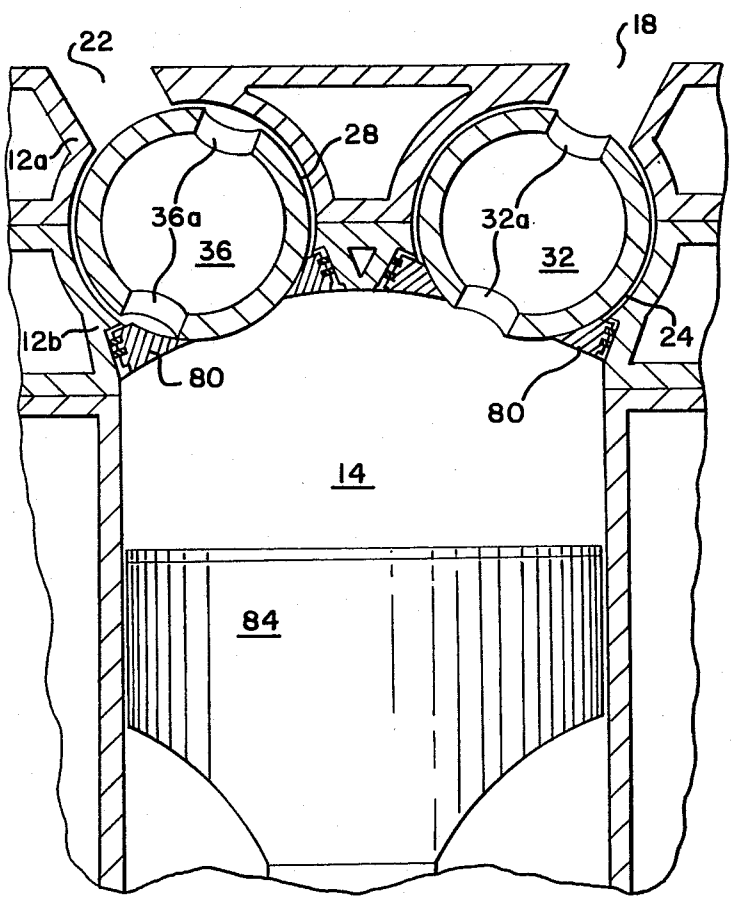
FIG. 3 is a slightly enlarged end view of one of the cylinders of cross section to show the rotary valves of the invention during the intake stroke of the piston.

FIG. 3–6 illustrates the position of the valve members during each cycle of operation of the four cycle internal combustion engine. In each of these figures, the piston 84 is shown in mid cycle as it is moving either upwardly or downwardly as indicated by the arrows in the particular stroke or cycle being illustrated. In FIG. 3 the piston is moving downwardly during the intake stroke or cycle. In this cycle of the engine, the valve member 32 has been rotated to a position wherein the through-channel **32*a* is aligned with the intake port 18 permitting air and combustible fuel such as gasoline to enter the cylinder 14 through the intake port 18 and the valve member 32. In this postion of the valve, the valve member 32 is in its lowest position spaced downwardly from the juncture of the chamber 24 and port 18 because the slide element 60 can only move perpendicular to the through-channel 32*a*This is shown also in the corresponding position of valve member 34 in FIG. 1**.

In FIG. 3 the valve member 36 controlling the movement of fluid through the exhaust port 22 from the cylinder 14 has been rotated to a position where the through-channel **36*a* is no longer in alignment with the port 22. Thus the exhaust port 22 is closed and although the valve member 36 could begin to move outwardly, perpendicular to the through-channel 36*a* there is nothing forcing it to do that during the intake of gasses through the port 18 and the valve member 32**.

Figure 4:
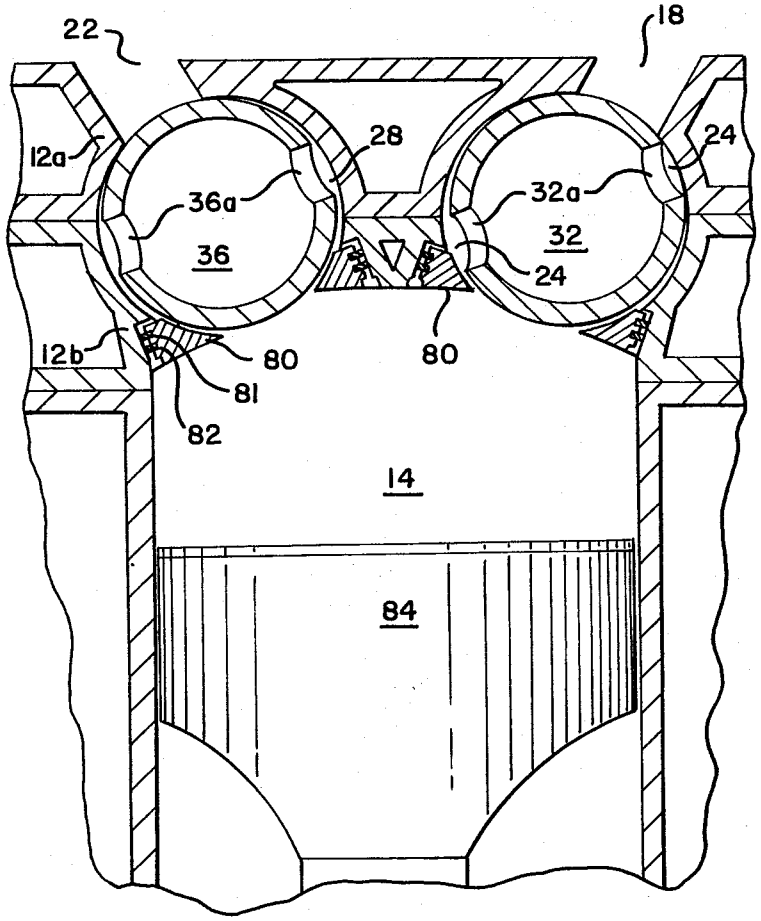
FIG. 4 is a slightly enlarged end view of the cylinder of FIG. 3 in cross sectioned to show the valves during the compression stroke of the piston.

In FIG. 4, the piston 84 has completed its intake stroke and is now moving upwardly in its compression stroke, compressing the gasses which have been drawn in through the intake port 18 and valve member 32. In this position, the valve members 32 and 36 have both been rotated so that neither is in alignment with the associated port. In this position, the compression of the gasses within the cylinder 14 forces the valve members 32 and 36 to move outwardly perpendicular to their respective through-channels **32*a* and 36*a*. This causes the valve members to sealingly engage the portions of their respective chambers 24 and 28 surrounding the juncture with their associated port. This position of the two valve members is best illustrated in the side elevational cross section of valve 32 in FIG. 1 wherein the slide members 60 of that valve have moved upwardly in the channel shaped guideways 62 of the two connectors 46 and 47**.

Figure 5:
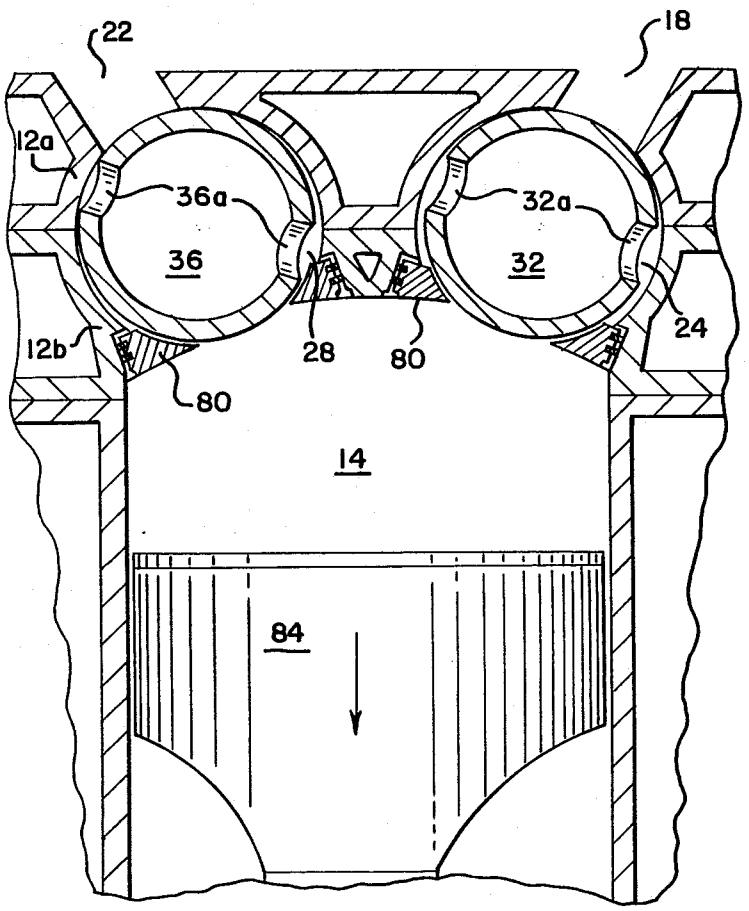
FIG. 5 is a slightly enlarged end view of the cylinder of FIG. 3 in cross sectioned to show the valves during the power stroke of the piston.

In FIG. 5, the piston 84 has completed its compression stroke at the top of the cylinder 14 and the spark from the spark plug (not shown) has ignited the compressed air and fuel mixture within the cylnder driving the piston 84 downwardly. This power stroke causes the valve members 32 and 36 which had been moved into sealing engagement with the walls of their respective chambers 24 and 28 around the intake port 18 and the exhaust port 22, to remain in sealing relationship with the port-surrounding portions of the chamber wall as they are being rotated and as the piston 84 moves downwardly in the cylinder 14.

Figure 6:
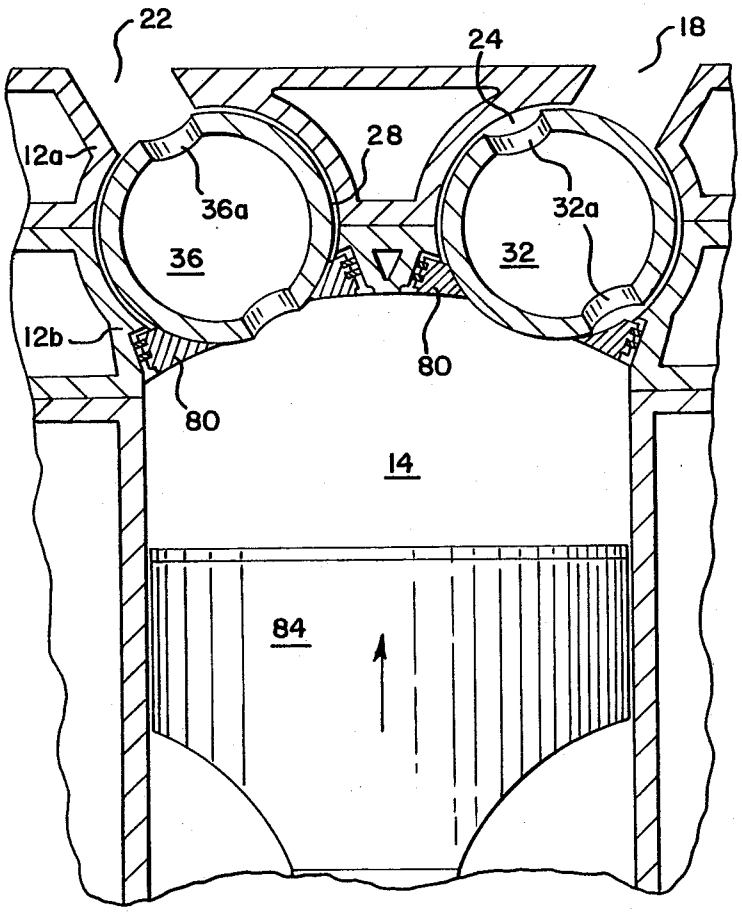
FIG. 6 is a slightly enlarged end view of the cylinder of FIG. 3 cross-sectioned to show the valves during the exhaust stroke of the piston.

In FIG. 6, the piston 84 has completed its downward power stroke and has moved back upwardly in the cylinder 14 during the exhaust stroke. In this cycle, the valve members 32 and 36 have been rotated to a position wherein the through-channel **36*a* of the valve member 36 is aligned with the exhaust port 22 and the combusted gasses within the cylinder 14 are in the process of being exhausted through the valve member 36 and the exhaust port 22. In this position of alignment of the through-channel 36a with the exhaust port 22, the valve member 36 is forced downwardly away from the portions of the chamber 28 surrounding the juncture with the exhaust port 22, so that it is centered with its rotational axis just as the valve member 32 had been forced downwardly in FIG. 3 when its through-channel 32*a* was aligned with the intake port 18. Because of the pressure of the exhausting of the cylinder 14 the valve member 32 remains upwardly disposed in sealing engagement with the wall of its chamber 24. After the piston 84 has fully exhausted the combusted gasses within the cylinder, it again moves downwardly at a time when the valve members 32 and 36 have moved toward the position illustrated in FIG. 3** to start the cycle all over again. It will be appreciated that the transverse movement of the valve members in their chambers may be on the order of a few thousandths of an inch but it is a movement which provides a novel sealing around the intake and exhaust ports during the compression and power strokes.

It may thus be seen that the valve members may be rotated in timing to permit the intake of a combustible mixture through the intake port 18 into the cylinder 14 as illustrated in FIG. 3, the compression of those gasses as illustrated in FIG. 4, the combustion of those gasses as illustrated in FIG. 5, and the exhausting of the products of combustion as illustrated in FIG. 6. The two valve members in each cylinder are rotated in time to one another and a very tight seal is provided through the mechanism of permitting the valve members to move transverse to the direction of their through-channels and to the axis of their rotation thus permitting these valve members to seal around their respective ports within the chambers in which they rotate. The combination of the rotation and transverse movement of the valve members provides a sweeping seal of the ports primarily during the compression and power cycles.

The valve system provides fewer moving parts and requires less precision machining. It provides a spherical valve chamber eliminating complicated valve angling systems. The air and exhaust flows are straight through the valves, thus reducing the height of the head and valve systems. With this system, the head casting is much less complex and there is less horsepower consumed with the valve system. The valve system is lighter in weight and provides an improved mixing of air and fuel mixture, and the rotating valves reduce the loss of unburned fuel through the exhaust port.

The foregoing description has been given by way of example and it will be apparent to those skilled in the art that modifications may be made in the disclosed structure without departing from the scope and true spirit of the invention as hereinafter claimed.

What is claimed is:

1. In an internal combustion engine having a cylinder encasement formed with a plurality of cylinders and an intake port and an exhaust port for each cylinder, an improved rotary valve system for said engine comprising an enlarged chamber disposed between and in fluid communication with an associated cylinder and an associated port, a rotary valve member for said chamber having a through-channel and mounted for rotation within said chamber about a first axis of movement transverse to said valve member through-channel to permit fluid flow through said chamber and between the associated port and cylinder when said through-channel is aligned with the associated port, said valve member being movable within said chamber along a predetermined second axis of movement transverse to said first axis of movement and transverse to said valve member through-channel as said valve member is being rotated about said first axis, valve member drive means connected to said valve member for rotating said valve member about said first axis while permitting transverse movement of said valve member along said second axis, whereby said valve member may move transversely outwardly in said chamber to sealingly engage the portions of said chamber surrounding the juncture with the associated port as said valve member is being rotated between the positions of alignement of said valve member through-channel and the associated port.

2. The structure of claim 1 wherein said valve member drive means includes a rotatable shaft and a connector member operatively connecting said rotatable shaft to said valve member for rotational driving of said valve member about its first axis and for permitting transverse movement of said valve member relative to said rotatable shaft and connector member along the predetermined second axis substantially normal to said first axis of rotation.

3. The structure of claim 2 wherein said valve member and connector members are operatively connected together for rotational driving and for relative transverse movement with respect to one another by means of a slide element attached to one of said members disposed within an elongated guideway formed in the other of said members, with the fit of the slide element within the guideway being such as to permit relative movement of said slide element only along the length of said guideway constituting said second axis of movement.

4. The structure of claim 2 wherein said predetermined second axis is substantially normal to said valve member through-channel.

5. The structure of claim 3 wherein said connector member and said rotatable shaft are connected together by means of a spline connection.

6. The structure of claim 3 wherein said side element is attached to said valve member and has elongated parallel sides in close sliding engagement with the sides of said guideway to prevent substantial lateral movement within said guideway, the ends of said slide element being outwardly tapered, and said guideway is formed in said connector member and is longer than said slide element, whereby relative sliding movement of said slide element within said guideway is permitted only along the longitudinal axis of said guideway.

7. The structure of claim 1 wherein said valve member is substantially spherical in shape and the through-channel for permitting the flow of fluid through said chamber is formed through the interior of said valve member.

8. In an internal combustion engine having a cylinder encasement formed with a plurality of cylinders and separate intake and exhaust ports for each cylinder, an improved rotary valve system for each of said cylinders, said valve system comprising a first enlarged spheroidal chamber formed within said associated intake port and a second enlarged chamber formed within said associated exhaust port, a spheroidal rotary valve member for each said chamber, said valve member having a through-channel and being mounted for rotation within said chamber for rotation about a rotational axis to permit fluid flow through said chamber and between the associated port and cylinder when said through-channel is aligned with the associated port, the rotational axis of said valve member in said intake port chamber associated with each cylinder being parallel to the rotational axis of said valve member in said exhaust port chamber associated with that cylinder, and valve member drive means connected to each of said valve members for rotating said valve members about their respective axes at one-fourth the crankshaft speed to permit sequentially within each cylinder in timing with the other cylinders, the intake of combustible fluids into the cylinder through said intake port, the compression of the fluids within the cylinder, the ignition of said compressed combustible fluids within the cylinder, and the exhaust of the products of combustion from the cylinder through said exhaust port.

9. In an internal combustion engine having a cylinder encasement formed with a plurality of cylinders and separate intake and exhaust ports for each cylinder, an improved rotary valve system for each of said cylinders, said valve system comprising a first enlarged spheroidal chamber formed within said associated intake port and a second enlarged chamber formed within said associated exhaust port, a spheroidal rotary valve member for each said chamber, said valve member having a through-channel and being mounted for rotation within said chamber for rotation about a rotational axis to permit fluid flow through said chamber and between the associated port and cylinder when said through-channel is aligned with the associated port, the rotational axis of said valve member in said intake port chamber associated with each cylinder being parallel to the rotational axis of said valve member in said exhaust port chamber associated with that cylinder, said valve member being movable within said chamber along a predetermined second axis of movement transverse to said first axis of movement and transverse to said valve member through-channel as said valve member is being rotated about said first axis, and valve member drive means connected to each of said valve members for rotating said valve members about their respective axes at one-fourth the crankshft speed to permit sequentially within each cylinder in timing with the other cylinders, the intake of combustible fluids into the chamber through said intake port, the compression of the fluids within the cylinder, the ignition of said compressed combustible fluids within the cylinder, and the exhaust of the products of combustion from the cylinder through said exhaust port.

* * * * *